United States Patent [19]

Becker et al.

[11] Patent Number: 4,946,114

[45] Date of Patent: Aug. 7, 1990

[54] METHOD AND DYE TUBE FOR UNIFORM COMPRESSION OF YARN

[76] Inventors: Josef Becker; Hubert Becker; Matthias Becker, all of Niederforstbacher Str. 80-84, D-5100 Aachen, Fed. Rep. of Germany

[21] Appl. No.: 438,808

[22] Filed: Nov. 20; 1989

Related U.S. Application Data

[63] Continuation-in-part of Ser. No. 299,755, Jan. 23, 1989, abandoned.

[30] Foreign Application Priority Data

Jan. 23, 1988 [DE] Fed. Rep. of Germany ..... 3801898
Aug. 18, 1988 [DE] Fed. Rep. of Germany ..... 3828082

[51] Int. Cl.[5] ..... B65H 75/18; B65H 75/20; B65H 75/24

[52] U.S. Cl. ..... 242/118.1; 242/1; 68/198

[58] Field of Search ..... 242/118.11, 118, 118.1, 242/118.2, 118.3, 1; 68/189, 198

[56] References Cited

U.S. PATENT DOCUMENTS 3,465,984 9/1969 Tigges et al. ..... 242/118.11
4,270,710 6/1981 Ono ..... 242/118.11
4,454,734 6/1984 Marquis et al. ..... 242/118.11 X
4,702,433 10/1987 Gilljam et al. ..... 242/118.11 X
4,823,565 4/1989 Hahm ..... 242/118.1 X

*Primary Examiner*—Stanley N. Gilreath
*Attorney, Agent, or Firm*—Arthur B. Colvin

[57] ABSTRACT

A yarn roll carrier tube and method of employing same to effect uniform compression of a yarn roll mounted on said tube is disclosed. The tube includes a central compressible portion, a contoured portion at one end, and an annular opening having a recessed stop portion at the other end. The tubes are sized such that the contoured portion may be inserted into and frictionally retained within the annular opening of a similar tube by a predetermined mount dictated by the position of said stop shoulder by the exertion of a compressive force exerted by one said tube against the other. Yarn rolls mounted on adjacent said tubes are partially compressed by the insertion of one tube into the other into said nested position, said insertion resulting in a preferential compression of the central portions of the yarn rolls. Subsequent compressive forces of a greater magnitude when exerted against the tubes result in axial foreshortening of the tubes and greater compression of the yarn rolls.

2 Claims, 4 Drawing Sheets

METHOD AND DYE TUBE FOR UNIFORM COMPRESSION OF YARN

This application is a continuation in part of application 299,755 filed Jan. 23, 1989 now abandoned.

BACKGROUND AND FIELD OF THE INVENTION

This invention relates to a method for uniform compression of yarn in the form of rolls mounted on axially telescoping and axially shortenable tubular yarn carriers. From a number of yarn carriers provided with yarn rolls a column is formed, and lastly an axial pressure is exerted on the column, thereby reducing its height by a defined amount to effect compression.

For carrying out the method, the invention further relates to a dye tube with two annular end sections and an axially shortenable center section. One end section, provided with a step projecting radially inwardly, has a circular inner contour. The latter is adapted to be nested with the outer contour of another end section. Owing to this relationship, the dye tube can be pushed by at least a portion of the axial extent of an end section into or onto a similarly designed dye tube, codirectionally by application of a first force. The shortenable center section has a plurality of axially spaced dividing rings.

PRIOR ART

For the uniform axial compressing of yarn rolls it is generally known to mount the rolls on axially telescoping or shortenable dye tubes, to arrange the latter in columnar form one above the other, and to shorten the column thus formed by an axial pressure. The purpose of this is to obtain a homogeneous yarn column which offers the same resistance throughout to a treatment medium flowing radially through the yarn rolls, which is a prerequisite for uniform yarn treatment. With the compression there results a displacement of the individual yarn rolls relative to the height of the dye tubes. If after the treatment the column is broken down into individual yarn roll/tube units, there is danger that the yarn rolls will be partly displaced beyond one end of their dye tube and to that extent will no longer be supported. During the further handling the convolutions lose their orderly placement, become tangled and interfere with the unwinding process, if continued processing of such a yarn roll is still possible at all.

To avoid displacement of the yarn rolls from a dye tube in the initially described method, it is generally known to apply on the dye tube a yarn roll whose axial length is much shorter than the axial length of the respective dye tube. However, this measure, which moreover allows a considerable part of the available winding height of a dye tube to remain unused, results in acceptable length differences between yarn roll and dye tube only if it is assured that the displacement of a yarn roll will not exceed the length difference.

From DE-OS 35 46 085 a method is known wherein the yarn is spooled on axially compressible and/or telescoping dye tubes, the yarn rolls thus formed again having an axial length which is shorter than the axial length of the dye tube. The spooled dye tubes are placed one on the other in columnar fashion, and subsequently an axially acting compressive pressure is exerted on the dye tubes and yarn rolls. Without disturbing the run of the yarn in the inner windings, it is proposed to axially compress the dye tubes and the yarn rolls simultaneously and substantially over the same period of time by the compressive pressure.

For this known method the advantage is claimed that relative movements between the elements forming the walls of the due tubes, on the one hand, and the inner windings of the yarn rolls, on the other hand, are eliminated, as compressing or pushing together of the dye tubes is always accompanied by compression of the yarn rolls. The occurring deformations are said to be the same in the dye tubes and in the yarn rolls. Relative movements of the inner yarn windings or yarn rolls along the elements of the dye tube walls are said to be obviated. Disturbances, clamping or damage in the inner yarn laps would thus also be eliminated.

A drawback of the noted method is that to exert compressive pressure simultaneously on dye tubes and yarn rolls in columnar arrangement despite their difference in axial length, it is imperative to provide between successive yarn rolls spacers which compensate for the differences in column length. Now these additionally required spacers result in a loss of yarn holding capacity for each column proportional to its volume, since depending on the degree of compression required for the yarn material the column must be formed of spacers of 25% and more of its height. In a dye vat charged with such columns, therefore, the yarn holding capacity thereof is also reduced by a proportionally large amount. Accordingly, a dyeing operation, for example, requires a correspondingly high bath:yarn ratio. As a result, not only is more energy needed for heating and circulating the bath, but also the amount of consumed treatment medium ultimately to be discharged and disposed of is increased, referred to the amount of yarn treated.

SUMMARY OF THE INVENTION

It is an object of the invention to propose a method of yarn compression wherein the yarn rolls need not have a substantially shorter length than the dye tubes and wherein spacers between the yarn rolls can be dispensed with while assuring that the yarn rolls will not be displaced beyond the end of the respective dye tubes.

Briefly stated, the various problems noted are solved by a method and apparatus wherein yarn rolls are mounted on carriers which when stacked and compressed result in an initial controlled telescoping of the carriers responsive to a first applied force with resultant relative movement of the yarn rolls such that the distal ends of adjacent rolls engage each other and shorten the length of the rolls.

Since by the axial pressure exerted on the dye tubes and on the yarn rolls the dye tubes are at first telescoped as per the invention, the end faces of the yarn rolls move from the ends of the dye tubes toward the center thereof, the process of compression of the yarn rolls is initiated without their being displaced beyond a dye tube end. After the dye tubes are telescoped by a defined portion of their height, the distance between the end faces of the yarn rolls and the ends of the dye tubes has increased to a maximum. Importantly, this initial compression, caused by roll to roll pressure rather than axial shortening of the tubes preferentially compresses the center less dense portions of the rolls due to the greater yarn density in the distal ends of the rolls. Under continued axial pressure there occurs a further shortening of the column exclusively by a shortening of the dye tubes themselves, whereby the process of compression of the yarn rolls is continued without any substantial relative movements taking place between the yarn roll and the dye tube, as both are axially shortened simultaneously until a compression uniform over the height of the column is achieved.

After a treatment process the axial pressure is relieved and the column is broken down into individual yarn roll/dye tube units, which expand axially by an amount by which the dye tube was initially shortened so that the end faces of the yarn rolls remain spaced from the ends of the dye tubes and can thus preserve their stable arrangement.

The process according to the invention facilitates a more uniform density than the prior art methods since as noted each yarn roll produced by cross winding has at first a different winding density over its height, the density being necessarily greater in the distal end regions of the yarn roll because of the thread reversal points than in the central region. Thus, as the dye tubes are being telescoped and the yarn rolls displaced accordingly, a compression of the central yarn roll region is initiated already, because that region offers least resistance to the compression. In the central yarn roll region the axial shortening required for uniform compression is greatest. This is compensated for by the fact that in this region the shortening of the dye tube in itself exerts its full effect and thus, in the end, each yarn roll and the column formed thereof show a compression completely uniform over its height To form a stable yarn roll column it is advantageous to use, in a manner known per se, a guiding element, for example, in the form of a perforated pipe, which serves as feed conduit for a treatment medium. Onto it a number of dye tubes with yarn rolls can be slipped successively, and the yarn rolls can be mutually rotated in such a way that the dye tubes can be inserted one into the other unhindered. This arrangement is facilitated if the axial length of the yarn rolls is slightly shorter than the axial length of the dye tubes. But this difference in length can be limited to a minimum required for the dye tubes to be inserted one into the other in angular alignment if necessary. For the amount of compression itself, however, this difference in length is of no importance, especially as it is at any rate smaller than the amount by which one dye tube is inserted into another dye tube.

To carry out the method of the invention, a dye tube of the initially described kind can be used. Such a dye tube is known for example from DE 3629401 A1. However, the axially shortenable central region of such dye tube results in a clamping of the thread layers lying directly over this region due to the slit type openings therein, so that they may be damaged, or at least will not be exposed to the dye bath in the same manner as the rest of the thread material. Clamping of the inner layers impedes the unwinding process, since the clamped turns still adhere to the central section of the dye tube when the dye tube is relieved of the axial compressive pressure.

Also from DE 3628571 A1 a dye tube is known already in which wedging in of the thread is avoided. To make the roll density homogeneous, this dye tube has a shortenable central region which is formed by mutually spaced tongues which originate alternately from a lower and upper dye tube region and can be inserted one into the other through gaps between the tongues of the respective dye tube region down into the end regions of the dye tube.

It is, however, relatively complicated to make such a dye tube. Also, without a relatively high cost of material the dye tube will not have the radial stability required to withstand the forces acting radially inward, resulting from the shrinking of a roll.

For carrying out the method of the invention, therefore, a dye tube is disclosed for which the yarn rolls need not have a substantially shorter axial length than the dye tube and for which in particular spacers between the yarn rolls can be dispensed with while yet preventing a displacement of the yarn rolls beyond the end of the respective dye tube and also avoiding that, in particular, the inner turns of a yarn roll which apply directly on the axially shortenable central section of the dye tube are wedged in.

For the solution of the dye tube problem there is provided a tube construction comprised of a series of coaxially disposed rings separated by compressible arched or tubular spacers, the axes of the spacers being aligned generally radially toward the longitudinal axis of the tube.

With the dye tube of the invention, a winding hardness different over the height of a roll can be made uniform in an efficient manner, with displacement of the winding regions over the winding surface kept to a minimum, so that upon the axial compression of a winding column formed of a number of wound dye tubes, thread wedging is eliminated. Also, frictional resistances resulting from thread convolutions resting directly on the winding surface are considerably reduced.

Through the new design of the dye tube the upper dye tube end section is axially insertable into an end section of an identical lower dye tube by a defined portion of the height, responsive to first compressive force whereas depending on the required compression the central dye tube section is axially shortenable due to the elasticity of the spacer elements, without thread wedging Consequently, a roll applied on the dye tube of the invention can be displaced in the required amount in its upper and lower end regions, which already have a greater winding hardness than the central region, and can be axially compressed considerably more in its central region where the winding hardness is lower, so that each winding area depending on its originally existing winding hardness, can be given an over-all homogeneous compression with a minimum of frictional resistance.

With an axial shortening of the dye tube of the invention the spacer elements assume an elliptical form without any parts of adjacent spacer elements or of the dividing rings being pressed against one another to the extent that thread layers at the central section of the dye tube would thereby be clamped.

According to an embodiment of the invention, the wall thickness of the spacer elements is thinner at the outer perimeter of the tube than at the inner perimeter, thereby additionally increasing the safety against parts of the spacer elements being pressed against each other in the region of the outer perimeter of the tube and hence in the region of the first turns of thread of a roll located there According to a further form of the invention, the insertable end section is connected with the dividing ring nearest it through inclined axially oriented webs evenly distributed over its circumference.

Due to this design, an end region of a yarn roll can be moved without appreciable resistance over the axially oriented webs before a shortening of the central section of the dye tube becomes necessary for uniform compression of the yarn roll as a whole.

Preferably, radial outer faces of the spacer elements lie on a diameter which is smaller than the outside diameter of the dividing rings.

By this design a random displacement of the yarn roll over the central section of the dye tube is avoided, as parts of the dividing rings project radially over the spacer elements.

According to a further form of the invention, the radial outer faces of the spacer elements lie on a diameter which is greater than the diameter on which radial outer faces of the web are arranged.

By this design the outer faces of the webs can be brought, without step formation, or interruption at an acute angle to the diameter which corresponds to the outside diameter of the insertable end section of the dye tube.

Lastly, a variant of the invention provides that spacer rings disposed in pairs of adjacent rows have center axes oriented parallel to each other, i.e. generally but not precisely radially of the tube.

Due to this design the new dye tube can be produced in a form which can be simpler than a form for dye tubes where all center axes of the spacer rings exactly coincide with the center axis of the dye tube.

DETAILED DESCRIPTION OF THE DRAWINGS

Figure 1:
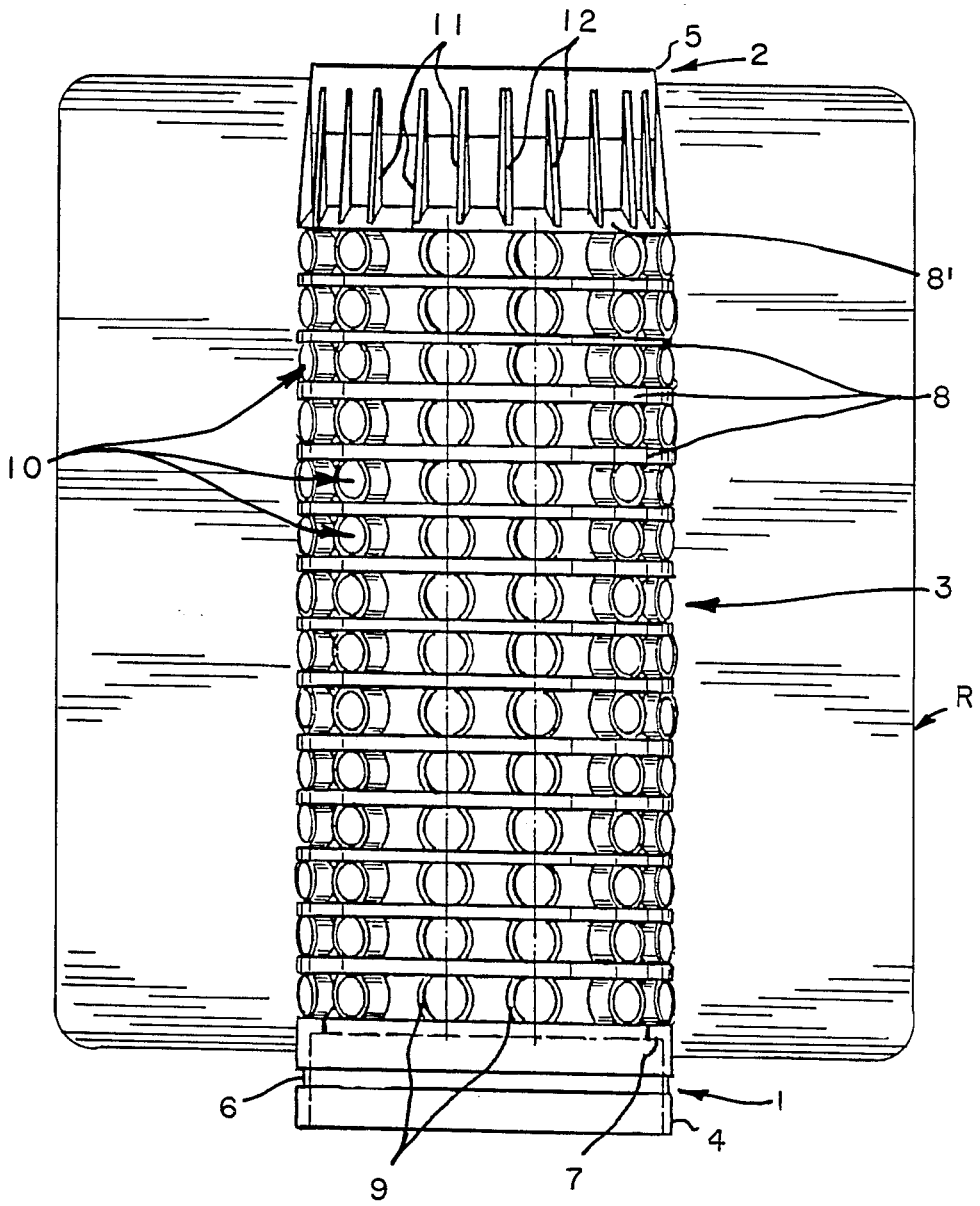
FIG. 1 is a side elevational view of a yarn carrier having a yarn roll mounted thereon

The die tube in accordance with the invention includes a lower annular end section 1, an upper annular end section 2, and an axially shortenable center section 3 The end section 1 is formed by a ring 4 and the end section 2 by a ring 5. A groove 6 is provided over the circumference of ring 4 and functions to received the so called thread reserve of yarn roll R.

Figure 3:
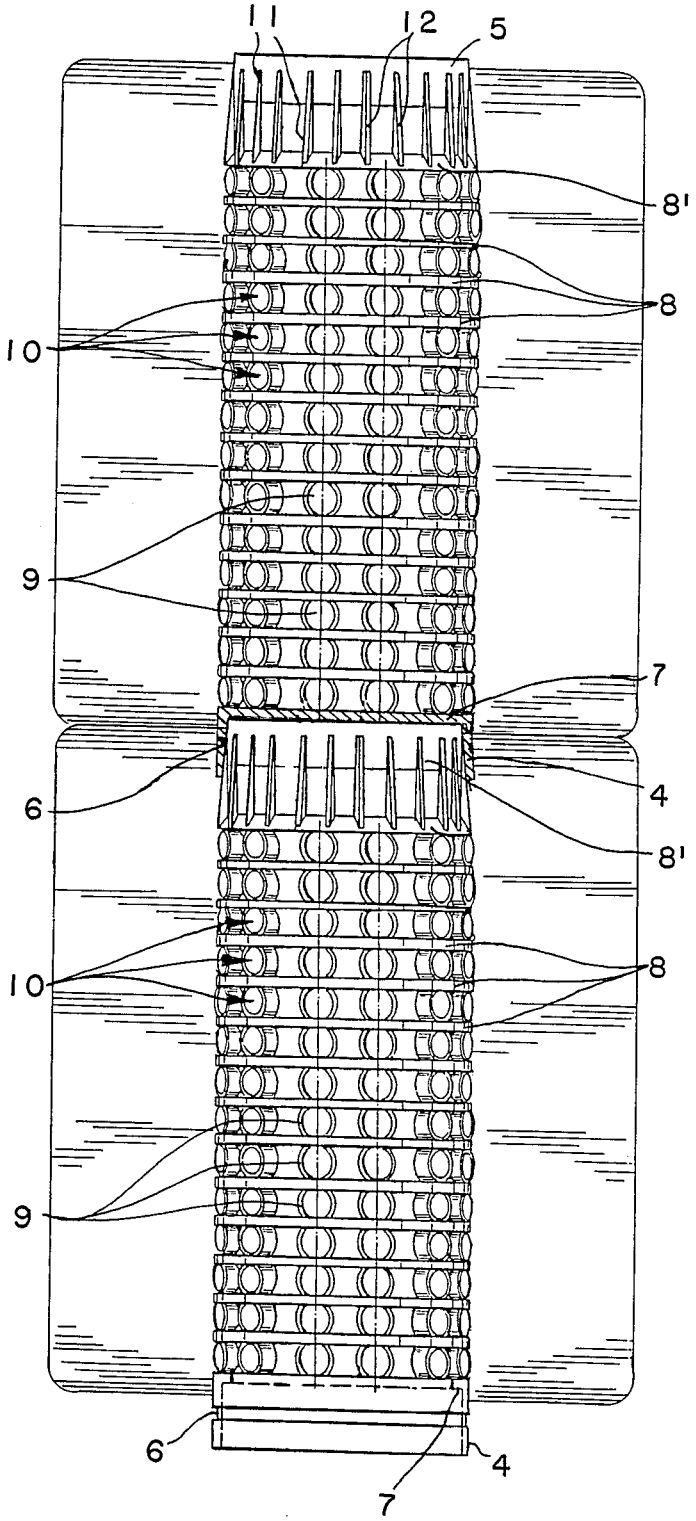
FIG. 3 is a view similar to FIG. 2 showing the yarn carriers and rolls in the fully nested condition.

The ring 4 is provided with an inwardly projecting annular step or stop shoulder 7 by which the depths of penetration of an identically design co-directional dye tube is definitively limited in that the end face of ring 5 of the inserted die tube, upon maximum penetration, will abut against step 7 (see FIG. 3).

Figure 4:
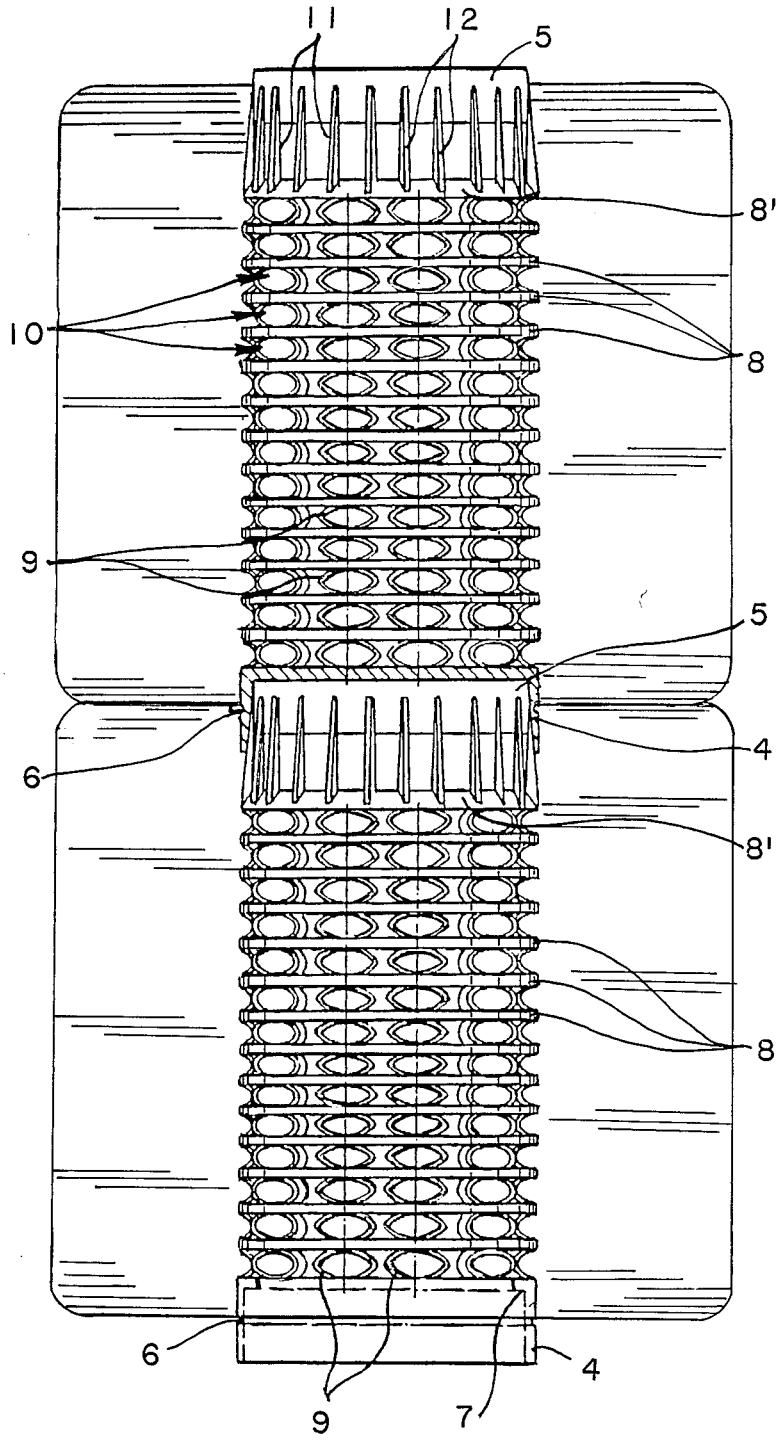
FIG. 4 is a view similar to FIG. 3 showing the position of the parts following application of forces to the carriers sufficient to axially foreshorten the same.

The central section 3 of the dye tube consists of dividing rings 8 arranged at uniform longitudinal spacings from one another and are connected together by spacer elements 9. As best seen in FIG. 4, upon compression of the dye tube in an axial direction, the spacers 9 of the various rings change to an elliptical configuration without parts of the spacer elements or dividing rings being pressed against each other thus avoiding wedging of the threads between adjacent spacers or dividing rings.

The ring 5 forming the end section of the carriers is connected with the dividing ring 8' nearest to it through webs 11 which are uniformly angularly distributed about the end ring 5. The webs 11 merge with the ring 5 at the portions thereof nearest the upper section 2 of the tube, and are angled radially outwardly the lowermost ends of the webs 11 merging with the outer circumference of the dividing ring 8'.

The method of achieving uniform compression of the yarn rolls R will now be described. While the drawings disclose two interconnected carriers (FIGS. 2–4) it will be evident that a large number of such carriers carrying rolls R would normally be employed.

Figure 2:
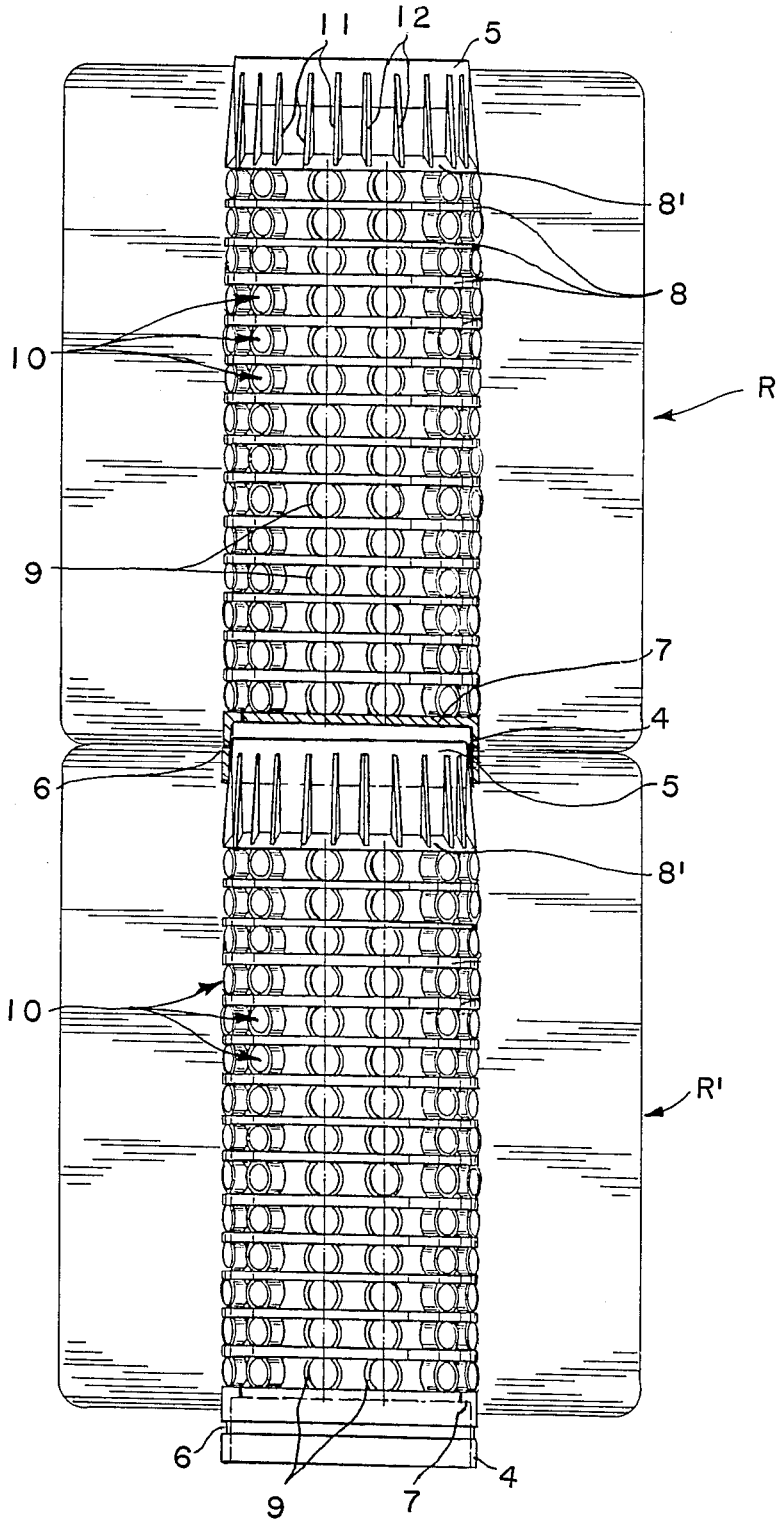
FIG. 2 is a view similar to FIG. 1 showing two yarn carriers having yarn rolls mounted thereon in the partially nested condition thereof portions of the carrier being shown in section.

In FIG. 2 it will be seen that two carriers or yarn tubes carrying yarn rolls R, R', are shown in partially nested condition. More particularly, the ring 5 of the lower tube has been partially introduced into the ring 4 of the upper tube. As will be evident from FIG. 2, the axial extent of the yarn rolls R, R' are such that the uppermost end of the roll R' prime is in engagement with the lower most end of the yarn roll R. Obviously, if a similar such yarn roll and carrier assembly is mounted above the roll R, the lowermost end of such roll would engage against the uppermost end of the roll R.

With the series of rolls an carriers positioned as shown in FIG. 2, and axial compressive force of a first magnitude is exerted against the endmost yarn tubes such force being sufficient to cause the end of rings 5 to engage against the stop shoulders 7 whereupon the tubes and rolls assume the fully nested position of FIG. 3. The tubes are so constructed that the force necessary to effect full nesting is less than the force necessary to effect axial compression or foreshortening of the carriers. The axial nesting (movement from FIG. 2 to FIG. 3) causes the abutting ends of the rolls R, R' to be shifted axially toward the centers of the carriers or tubes on which the yarn rolls are mounted. Since the thread density due to crossing patterns of the yarns is inherently greater in the areas adjacent the abutting ends of the respective yarn rolls, the initial nesting movements described will preferentially compress the central portions of the yarn rolls since the denser distal ends of the rolls are more resistant to compression. Accordingly, when the yarn rolls achieve the position of FIG. 3, the yarn density is essentially equalized throughout the extent of the roll.

Thereafter, a second and greater compressive force is applied to the end most of the carrier tubes resulting in the compression of the spacers 9 from an essentially circular to an elliptical configuration as depicted in FIG. 4. The further axial force applied thus further compresses the yarn on rolls R and R' such compression resulting in an essentially equal yarn density throughout the extent of the rolls R and R'.

In conventional yarn compression systems, yarn compression is achieved solely as a result of axial foreshortening of the yarn tubes. In such systems, it will be evident that the greater compression of the distal ends of the yarn rolls will be carried over into the compressed yarn rolls since there is no preferential compression of the central portions of the rolls. In contrast, in accordance with the method of the invention, the compression of the yarn is carried out in two steps, namely a first compression effected by roll to roll pressure and a second compression as a result of axial foreshortening of the carriers. There is thus achieved in accordance with the method of invention a more uniform compression of the yarn and hence a more uniform treatment than is available with prior art methods without the use of wasteful spacers or like paraphernalia. In addition, by virtue of the interfit of the tubes, and inter-relation of the rolls with the tubes, there is no possibility of a yarn roll becoming disengaged from its carrier tube.

We claim:

1. The method for the compression of yarn rolls to achieve a substantially uniform yarn density said rolls having an initial yarn density adjacent the distal ends greater than the yarn density at the central portions comprising the steps of providing a series of yarn carriers adapted to be inserted into said rolls, said carriers being characterized in that said carriers, when mounted in end to end engaging relation, are adapted to partially nest by a predetermined distance when subject to a first axial compressive force and to decrease uniformally in length when subjected in said nested condition to a second and greater axially compressive force, mounting a yarn roll to be compressed on each said carrier, thereafter placing a series of said yarn carriers in end to end relation to form a column of said carriers such that the spacing of the distal ends of adjacent said rolls is less than said predetermined distance, thereafter applying a first compressive force to the ends of the outermost said carriers of said column to thereby move said carriers to said partially nested position and to shift said yarn rolls toward each other by said predetermined distance, whereby the distal ends of adjacent said rolls are brought into contact with each other and said rolls are axially foreshortened by axial compressive forces exerted between adjacent said rolls, said foreshortening occurring preferentially in said central portion of said rolls, and thereafter applying a further compressive force to said carriers to axially foreshorten said yarn carriers and said yarn rolls to thereby compress the yarn substantially uniformly.

2. A yarn carrier for uniformly compressing yarn rolls thereon comprising a tube having an upper and a lower distal end and an intermediate section connecting said ends, said intermediate section being axially compressible, an annular stop shoulder formed in one said distal end inwardly of said distal end, the other said distal end including a contoured portion adapted to telescope within another said tube by a predetermined distance responsive to a first axially exerted force to abut the annular stop shoulder of said another tube, said first force being less than the force required to axially compress said intermediate section, said contoured portion including axially extending webs angularly spaced about said distal end, said webs sloping radially outwardly relative to the axis of said tube from a narrowest portion adjacent said distal end to a widest portion adjacent said intermediate section, said contoured portion being sized to be frictionally engaged within the distal end of another said tube responsive to said first axially exerted force.

* * * * *